US006964492B1

(12) United States Patent
Nicklowitz

(10) Patent No.: US 6,964,492 B1
(45) Date of Patent: Nov. 15, 2005

(54) ILLUMINABLE CONTAINER

(76) Inventor: Robert Nicklowitz, 16915 Mayfield, Livonia, MI (US) 48154

( * ) Notice: Subject to any disclaimer, the term of this patent is extended or adjusted under 35 U.S.C. 154(b) by 102 days.

(21) Appl. No.: 10/653,571

(22) Filed: Sep. 2, 2003

(51) Int. Cl.[7] ..... F21V 33/00; F21K 2/06
(52) U.S. Cl. ..... 362/101; 362/34; 362/96; 362/457
(58) Field of Search ..... 362/375, 34, 96, 362/101, 377, 457, 156

(56) References Cited

U.S. PATENT DOCUMENTS 5,504,663 A 4/1996 Tucker
6,254,247 B1 7/2001 Carson
6,474,467 B1 11/2002 Kurdian
6,520,657 B1 2/2003 DeNicola
6,739,731 B2 * 5/2004 Katzman ..... 362/101

* cited by examiner

*Primary Examiner*—Sandra O'Shea
*Assistant Examiner*—Guiyoung Lee
(74) *Attorney, Agent, or Firm*—Michael I Kroll

(57) ABSTRACT

An illuminable container for providing illumination has a body with a base. The body is able to retain liquid therein. A recess extends through the base and a retention channel aligned with recess in the base and extends upward into the body. The retention channel is able to receive a light source, which upon activation, illuminates the container.

13 Claims, 10 Drawing Sheets

ILLUMINABLE CONTAINER

BACKGROUND OF THE INVENTION

1. Field of the Invention

The present invention relates generally to luminescent devices and, more specifically, to a liquid container with a retention channel extending upwardly into the container from the base of the container. The retention channel is able to receive a chemilluminescent light source for illumination the container and it's contents.

2. Description of the Prior Art

Numerous are other portable luminescent devices are provided in the prior art. These known devices generally require a source of external electricity in order to be illuminated. Additionally, there portable luminescent devices have a single function which is to provide illumination to a dark area. While these portable luminescent devices may be suitable for the purpose for which they were designed, they would not be as suitable for the purpose of the present invention, as hereinafter described.

SUMMARY OF THE PRESENT INVENTION

The present invention relates generally to luminescent devices and, more specifically, to a liquid container with a channel extending upwardly into the container from the base of the container. The channel is able to receive a chemiluminescent light source for illuminating the container and it's contents.

A primary object of the present invention is to provide an illuminable container that overcomes the shortcomings of the prior art.

Another, secondary object of the present invention is to provide an illuminable container having a channel extending upwardly therein from the base of the container.

Yet another object of the present invention is to provide an illuminable container having a source of light positioned within the channel for increasing the visibility of the container and the area proximate thereto.

An even further object of the present invention is to provide an illuminable container having a docking port positioned at an end of a lip of the channel lip for securing the light source therein.

Still yet another object of the present invention is to provide an illuminable container wherein the light source is chemilluminescent.

Still another object of the present invention is to provide an illuminable container that uses a hermetically sealed source of chemilluminescent light that will not be compromised when the container submerged.

A further object of the present invention is to provide an illuminable container having a base cap for selectively enclosing the light source within the channel.

An even further object of the present invention is to provide an illuminable container wherein the base cap has a reflective material attached thereto for increased light reflection through the container.

Another object of the present invention is to provide an illuminable container that may be used as a source of light.

Yet another object of the present invention is to provide an illuminable container that is aesthetically pleasing.

Yet another object of the present invention is to provide an illuminable container that is inexpensive to manufacture and operate.

One more object of the present invention is to provide an illuminable container that is simple and easy to use.

Additional objects of the present invention will appear as the description proceeds.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same of similar parts throughout the several views.

BRIEF DESCRIPTION OF THE DRAWING FIGURES

In order that the invention is more fully understood, it will now be described, by way of example, with reference to the accompanying drawing in which.

DESCRIPTION OF THE REFERENCED NUMERALS

Figure 1:
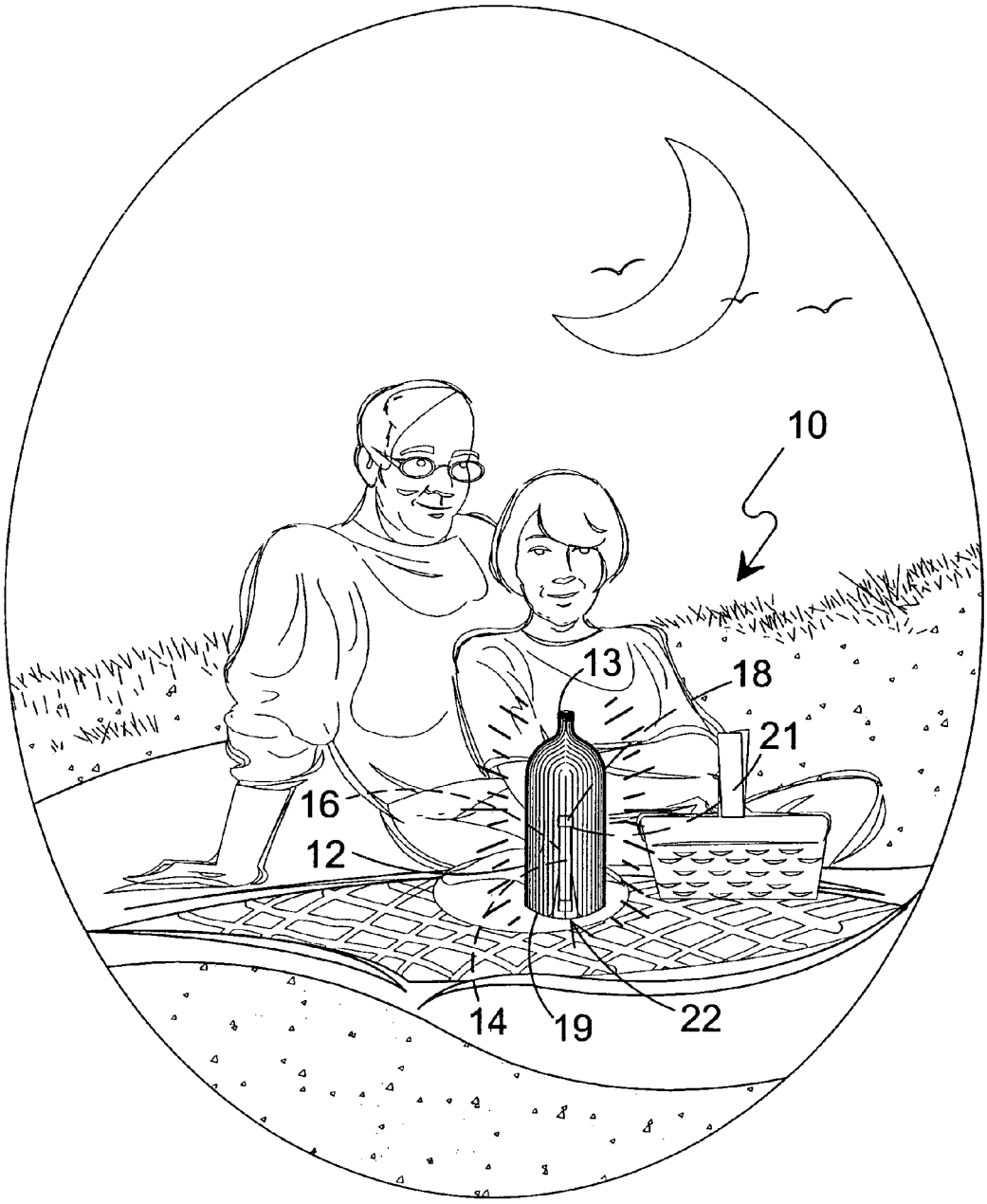
FIG. 1 is an illustrative view of the illuminable container of the present invention in use.

Turning now descriptively to the drawings, in which similar reference characters denote similar elements throughout the several views, the Figures illustrate the illuminable container of the present invention. With regard to the reference numerals used, the following numbering is used throughout the various drawing Figures.

10 illuminable container of the present invention
12 body
13 top end
14 light source
16 retention channel
18 docking port
19 base
20 base cover
21 lip
22 recess

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning now descriptively to the drawings, in which similar reference characters denote similar elements throughout the several views, FIGS. 1 through 10 illustrate an illuminable container of the present invention generally by the numeral 10.

FIG. 1 is an illustrative view of the illuminable container 10 (hereinafter "container") of the present invention in use. The container 10 of the present invention has an outer body 12 having a top end 13 with an opening for adding liquid to and pouring liquid out from the body 12 of the container 10. The container also has a base 19 positioned on an end opposite the top end 13. The base 19 is flat so as to provide stability to the container 10 of the present invention. The base 19 has a recess 22 extending therethrough. The recess 22 is positioned at substantially the center of the base 19 and is beveled. The base 19 can be formed in any shape which corresponds to the shape of the body 12 of the container 10. The body 12 is preferably formed from a transparent or translucent material so as to allow light to easily pass therethrough.

A retention channel 16 extends upward from the base 19 and is aligned with the recess 22. Preferably the retention channel 16 is integrally formed with the body 12 of the container 10. The retention channel 16 can extend upward into the body 12 at any desired height so long as the retention channel 16 does not prevent the inflow of liquid into the container 10. The retention channel 16 is able to receive a light source 14 through the recess 22 in the base 19. Preferably the retention channel 16 is cylindrical in shape, however, the retention channel 16 may be formed in any shape. The retention channel 16 has a diameter that is substantially equal to the diameter of the light source 14 thereby ensuring a secure fit after insertion of the light source 14 into the retention channel 16 via the recess 22. The retention channel 16 has a docking port 18 positioned at an end opposite the base 19 of the container 10. The locking port 18, has a lip 21 for locking the light source 14 securely therein.

The light source 14 is preferably cylindrical having a diameter substantially equal to the diameter of the retention channel 16. The light source 14 is described as cylindrical for purposes of example. Similar to the retention channel 16, the light source 14 can be formed from any shape which corresponds with the shape of the retention channel 16. The light source 14 is preferably chemilluminescent so as to provide a strong source of light that is self-contained and does not require any external power. Having a chemilluminescent light source 14 is described only for purposes of example and any type of light source that is self contained and does not require external power may be used as the light source 14 for the container 10 of the present invention.

As discussed above, the light source 14 is inserted into the retention channel 16 through the recess 22 in the base 19. Prior to insertion therein, the light source must be activated by a user. Upon activation of the light source 14 and receipt by the retention channel 16 of thereof, light is provided through the body 12. The light from the light source 14 is refracted and reflected through any liquid contained within the container 10 and further refracted and reflected through the body 12 in order to provide light to the immediate area surrounding the container 10 of the present invention.

The illuminable container 10 of the present invention may be used in a dark setting in order to provide a base of light. Additionally, in low light conditions, the light produced by the container 10 aids a person trying to obtain a drink from the contents of the container 10 and also to help a person attempting to refill the container 10 with a liquid. Furthermore, the illuminable container 10 of the present invention could be used aesthetically for decorative purposes as well as for functional purposes. As the body 12 can be formed from any type of material, the container 10 of the present invention can be manufactured based on the requirements and needs of the user.

Figure 2:
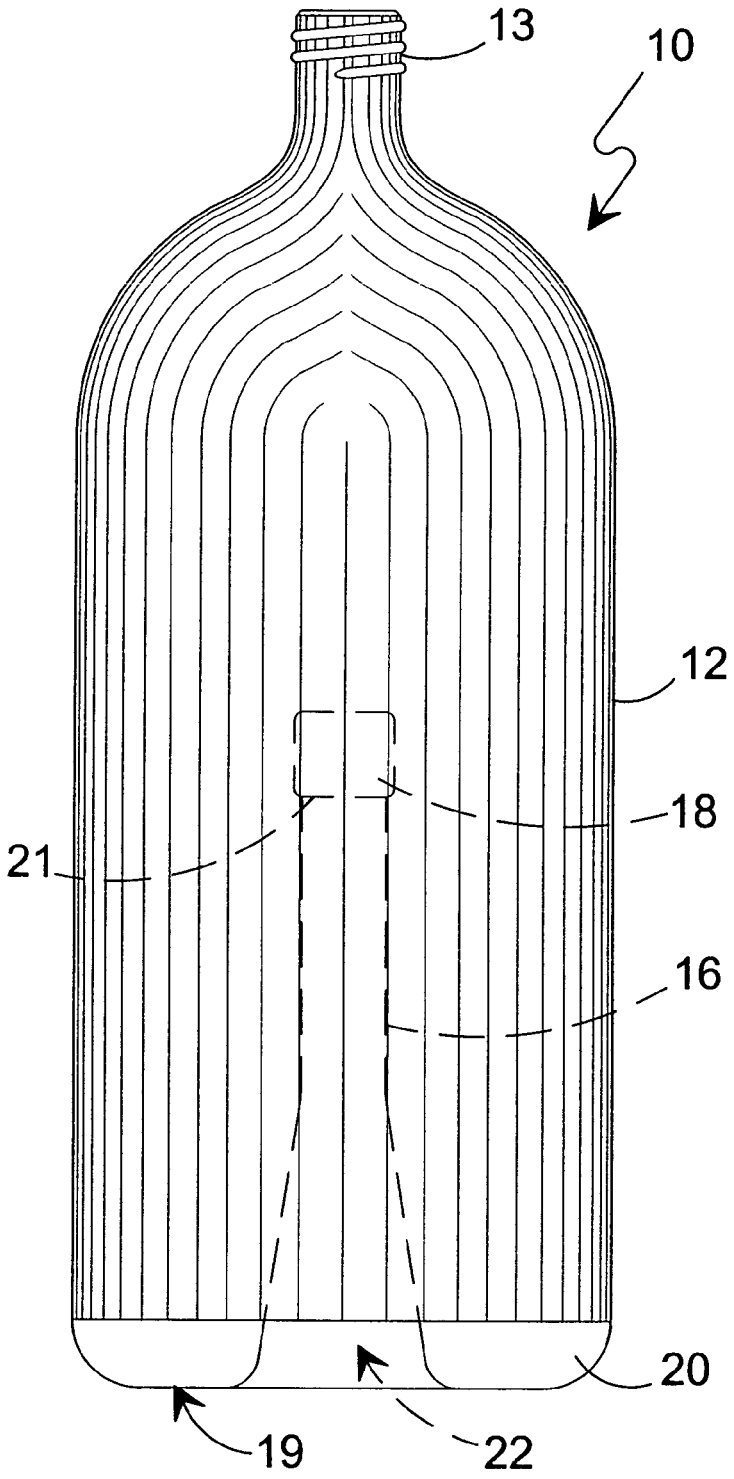
FIG. 2 is a side view of the illuminable container of the present invention without a light source.

FIG. 2 is a side view of the illuminable container of the present invention without a light source. The container 10 of the present invention has an outer body 12 having a top end 13 with an opening for adding liquid to and pouring liquid out from the body 12 of the container 10. The container also has a base 19 positioned on an end opposite the top end 13. The base 19 is flat so as to provide stability to the container 10 of the present invention. The base 19 has a recess 22 extending therethrough. The recess 22 is positioned at substantially the center of the base 19 and is beveled. The base 19 can be formed in any shape which corresponds to the shape of the body 12 of the container 10. The body 12 is preferably formed from a transparent or translucent material so as to allow light to easily pass therethrough.

A retention channel 16 extends upward from the base 19 and is aligned with the recess 22. Preferably the retention channel 16 is integrally formed with the body 12 of the container 10. The retention channel 16 can extend upward into the body 12 at any desired height so long as the retention channel 16 does not prevent the inflow of liquid into the container 10. The retention channel 16 is able to receive a light source 14 through the recess 22 in the base 19. Preferably the retention channel 16 is cylindrical in shape, however, the retention channel 16 may be formed in any shape. The retention channel 16 has a diameter that is substantially equal to the diameter of the light source 14 thereby ensuring a secure fit after insertion of the light source 14 into the retention channel 16 via the recess 22. The retention channel 16 has a docking port 18 positioned at an end opposite the base 19 of the container 10. The locking port 18 has the lip 21 for locking the light source 14 securely therein.

A base cover 20 may be optionally positioned adjacent to the base 19 of the container 10 of the present invention. The retention channel 16 or an outside of the base 19 may optionally have threads to receive matching threads positioned on the base cover 20. The base cover 20 is preferably beveled and is screwed to the base 19 of the body 12 via the matching threads located within the beveled recess 20. However, the base cover 20 may be secured to the base 19 of the body 12 in any manner. The base cover 20 may also have a coating that is reflective, such as a mirror, so as to enhance the amount of light that is emitted through the contents of the body 12 and the body 12 thereby causing the container 10 to be illuminated more effectively. Also, connecting a base cover 20 to the base 19 provides the container 10 with additional stability by providing a greater surface area on which the container 10 is balanced. The base cover 20 is described for purposes of example and used in order to enhance the light emitted by the light source and provide additional stability to the container 10. However, the container 10 of the present invention does not require the positioning of the base cover 20 adjacent to the base 19 of the body 12.

Figure 3:
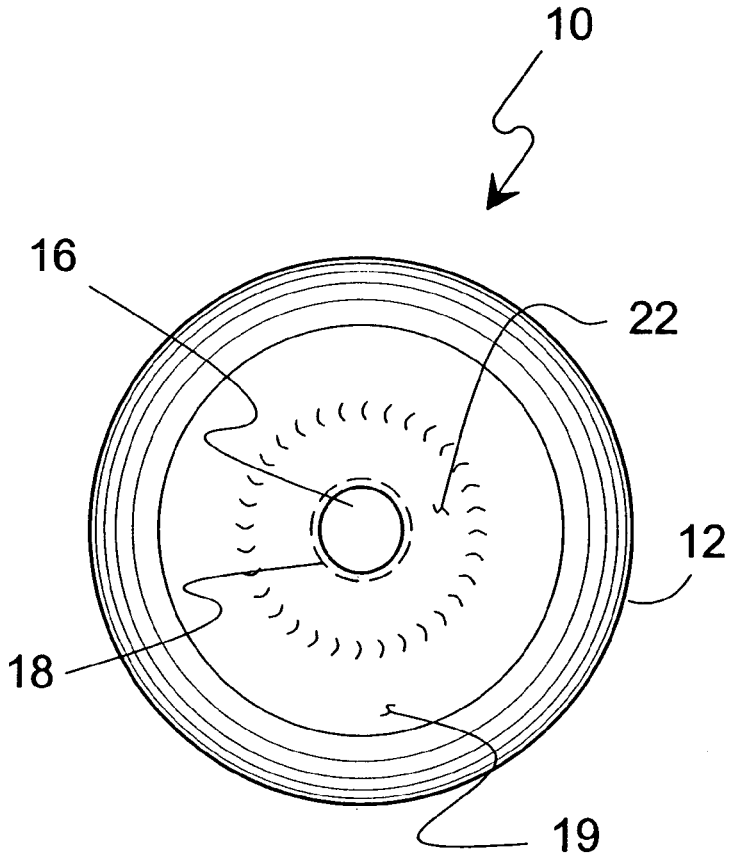
FIG. 3 is a bottom perspective view of the illuminable container of the present invention without a light source.

FIG. 3 is a bottom view of the illuminable container of the present invention without a light source. The container 10 of the present invention has an outer body 12 having a top end 13 with an opening for adding liquid to and pouring liquid out from the body 12 of the container 10. The container also has a base 19 positioned on an end opposite the top end 13. The base 19 is flat so as to provide stability to the container 10 of the present invention. The base 19 has a recess 22 extending therethrough. The recess 22 is positioned at substantially the center of the base 19 and is beveled. The base 19 can be formed in any shape which corresponds to the shape of the body 12 of the container 10. The body 12 is preferably formed from a transparent or translucent material so as to allow light to easily pass therethrough.

A retention channel 16 extends upward from the base 19 and is aligned with the recess 22. Preferably the retention channel 16 is integrally formed with the body 12 of the container 10. The retention channel 16 can extend upward into the body 12 at any desired height so long as the retention channel 16 does not prevent the inflow of liquid into the container 10. The retention channel 16 is able to receive a light source 14 through the recess 22 in the base 19 as shown in FIGS. 1 and 6–10. Preferably the retention channel 16 is cylindrical in shape, however, the retention channel 16 may be formed in any shape. The retention channel 16 has a diameter that is substantially equal to the diameter of the light source 14 thereby ensuring a secure fit after insertion of the light source 14 into the retention channel 16 via the recess 22. The retention channel 16 has a docking port 18 positioned at an end opposite the base 19 of the container 10. The locking port 18 has the lip 21 for locking the light source 14 securely therein.

As shown in FIG. 3, the base 19 is circular and has a recess 22 which is beveled. The beveled recess allows a user to easily insert and secure the light source 14 within the chamber 16 and also allows a user to easily remove the light source 14 when the light source 14 is no longer emitting light or when the user selectively desires the light source 14 to be removed. The recess 22 is also optionally able to receive the base cover 20 as discussed in FIG. 2 for additional stability as well as enhanced light reflection.

Figure 4:
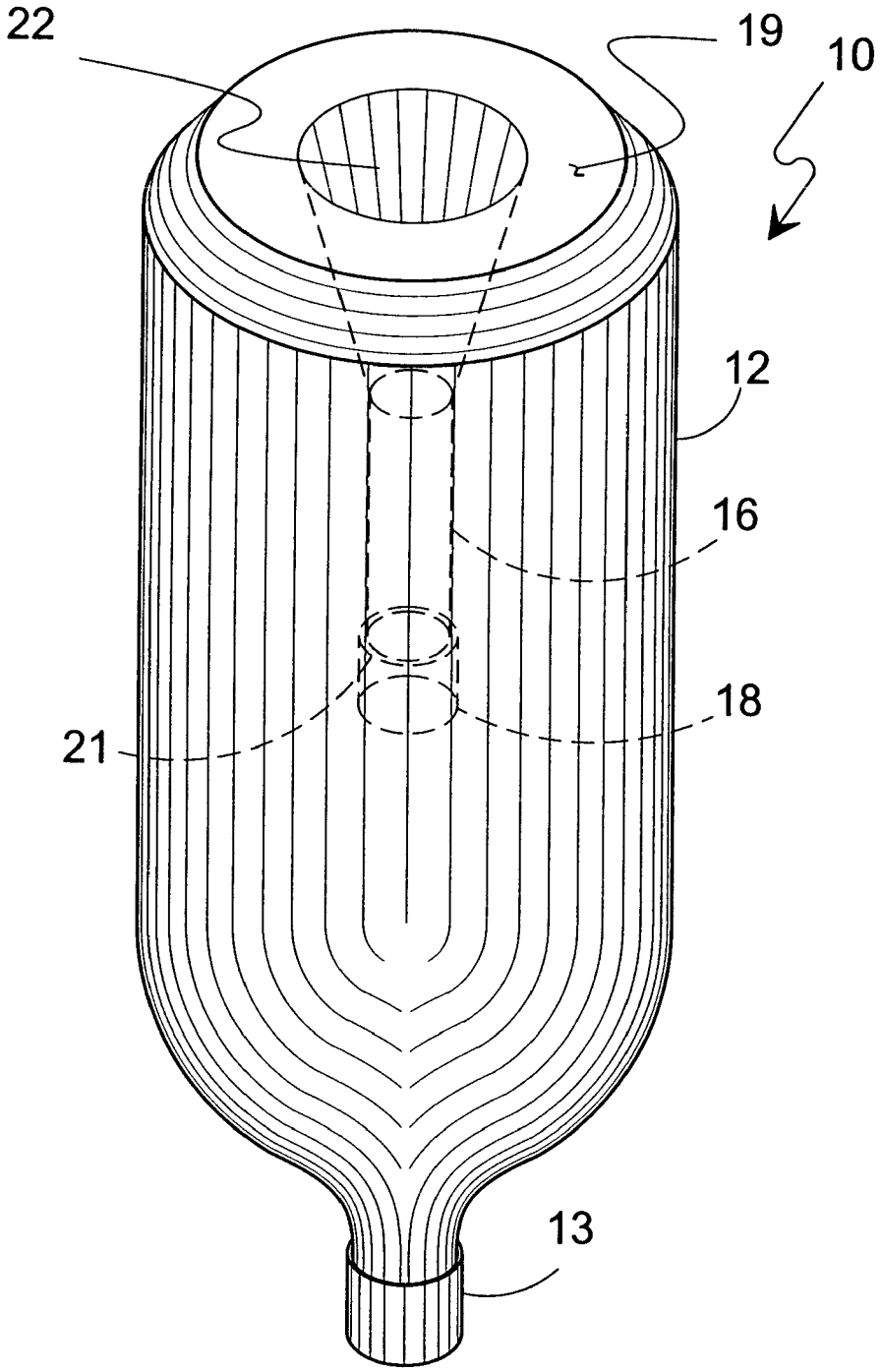
FIG. 4 is a bottom perspective view of the illuminable container of the present invention showing the channel that receives the light source.

FIG. 4 is a bottom perspective view of the illuminable container of the present invention showing the channel that receives the light source. The container 10 of the present invention has an outer body 12 having a top end 13 with an opening for adding liquid to and pouring liquid out from the body 12 of the container 10. The container also has a base 19 positioned on an end opposite the top end 13. The base 19 is flat so as to provide stability to the container 10 of the present invention. The base 19 has a recess 22 extending therethrough. The recess 22 is positioned at substantially the center of the base 19 and is beveled. The base 19 can be formed in any shape which corresponds to the shape of the body 12 of the container 10. The body 12 is preferably formed from a transparent or translucent material so as to allow light to easily pass therethrough.

A retention channel 16 extends upward from the base 19 and is aligned with the recess 22. Preferably the retention channel 16 is integrally formed with the body 12 of the container 10. The retention channel 16 can extend upward into the body 12 at any desired height so long as the retention channel 16 does not prevent the inflow of liquid into the container 10. The retention channel 16 is able to receive a light source 14 through the recess 22 in the base 19. Preferably the retention channel 16 is cylindrical in shape, however, the retention channel 16 may be formed in any shape. The retention channel 16 has a diameter that is substantially equal to the diameter of the light source 14 thereby ensuring a secure fit after insertion of the light source 14 into the retention channel 16 via the recess 22. The retention channel 16 has a docking port 18 positioned at an end opposite the base 19 of the container 10. The locking port 18 has the lip 21 for locking the light source 14 securely therein.

FIG. 4 shows the retention channel 16 of the container 10 of the present invention without the light source positioned therein. Also shown is the beveled recess 22 positioned within the base 19 of the container 10 of the present invention. When the user desires to illuminate the container 10, the user inserts the light source through the recess 22 and secures it within the retention channel 16. The container 10 is then illuminated and can be used for the desired purpose.

Figure 5:
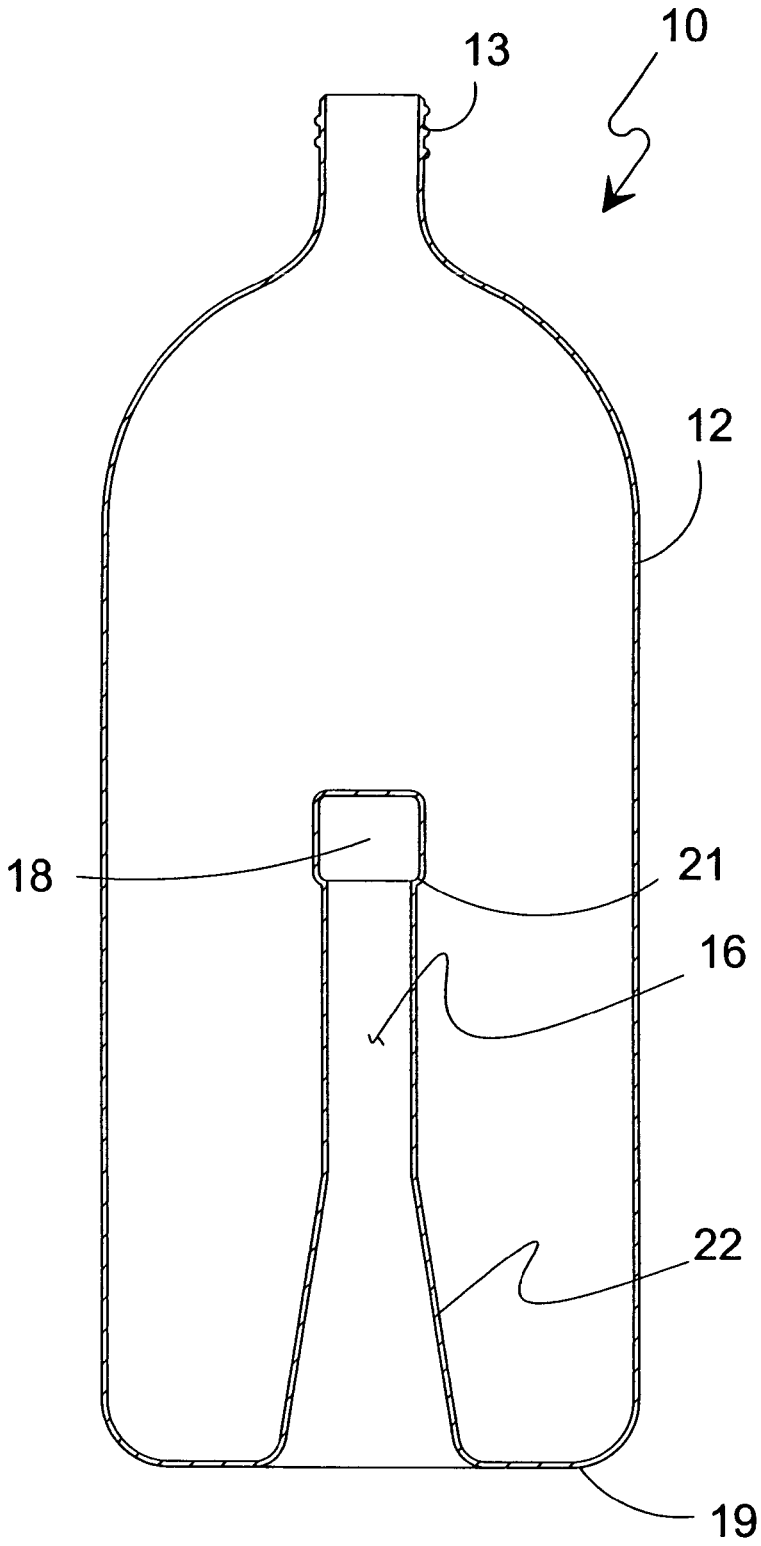
FIG. 5 is a side cross-sectional view of the illuminable container of the present invention.

FIG. 5 is a cross-sectional view of the illuminable container of the present invention. The container 10 of the present invention has an outer body 12 having a top end 13 with an opening for adding liquid to and pouring liquid out from the body 12 of the container 10. The container also has a base 19 positioned on an end opposite the top end 13. The base 19 is flat so as to provide stability to the container 10 of the present invention. The base 19 has a recess 22 extending therethrough. The recess 22 is positioned at substantially the center of the base 19 and is beveled. The base 19 can be formed in any shape which corresponds to the shape of the body 12 of the container 10. The body 12 is preferably formed from a transparent or translucent material so as to allow light to easily pass therethrough.

A retention channel 16 extends upward from the base 19 and is aligned with the recess 22. Preferably the retention channel 16 is integrally formed with the body 12 of the container 10. The retention channel 16 can extend upward into the body 12 at any desired height so long as the retention channel 16 does not prevent the inflow of liquid into the container 10. The retention channel 16 is able to receive a light source 14 through the recess 22 in the base 19. Preferably the retention channel 16 is cylindrical in shape, however, the retention channel 16 may be formed in any shape. The retention channel 16 has a diameter that is substantially equal to the diameter of the light source 14 thereby ensuring a secure fit after insertion of the light source 14 into the retention channel 16 via the recess 22. The retention channel 16 has a docking port 18 positioned at an end opposite the base 19 of the container 10. The locking port 18 has the lip 21 for locking the light source 14 securely therein.

The cross-sectional view of the container 10 shows the method by which the light source 14 maybe held securely within the retention channel 16 of the container 10. The retention channel 16, at an end opposite the recess 22 has a docking port 18 which has the lip 21 for retaining an end of the light source securely therein. The light source is inserted through the recess 22 and is received by the retention channel 16. The user applies pressure to an end of the light source 14 so that the light source 14 snaps into place within the docking port 18. The user can selectively remove the light source 14 by pulling on the end of the light source 14 not enclosed by the docking port 18 in order to dislodge the light source 14 from the docking port 18.

Figure 6:
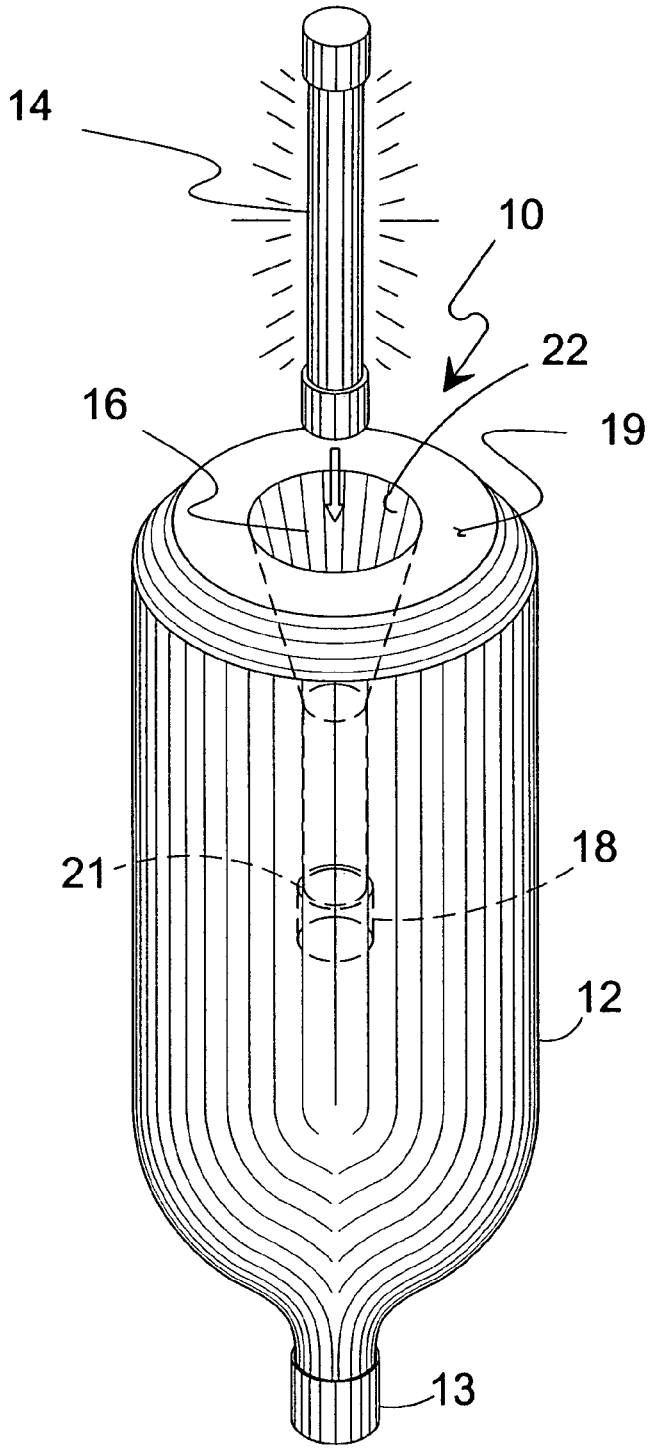
FIG. 6 is an exploded bottom perspective view of the illuminable container of the present invention showing the insertion of a light source.

FIG. 6 is an exploded perspective view of the illuminable container of the present invention having a light source inserted therein. The container 10 of the present invention has an outer body 12 having a top end 13 with an opening for adding liquid to and pouring liquid out from the body 12 of the container 10. The container also has a base 19 positioned on an end opposite the top end 13. The base 19 is flat so as to provide stability to the container 10 of the present invention. The base 19 has a recess 22 extending therethrough. The recess 22 is positioned at substantially the center of the base 19 and is beveled. The base 19 can be formed in any shape which corresponds to the shape of the body 12 of the container 10. The body 12 is preferably formed from a transparent or translucent material so as to allow light to easily pass therethrough.

A retention channel 16 extends upward from the base 19 and is aligned with the recess 22. Preferably the retention channel 16 is integrally formed with the body 12 of the container 10. The retention channel 16 can extend upward into the body 12 at any desired height so long as the retention channel 16 does not prevent the inflow of liquid into the container 10. The retention channel 16 is able to receive a light source 14 through the recess 22 in the base 19. Preferably the retention channel 16 is cylindrical in shape, however, the retention channel 16 may be formed in any shape. The retention channel 16 has a diameter that is substantially equal to the diameter of the light source 14 thereby ensuring a secure fit after insertion of the light source 14 into the retention channel 16 via the recess 22. The retention channel 16 has a docking port 18 positioned at an end opposite the base 19 of the container 10. The locking port 18 has a lip for locking the light source 14 securely therein.

The light source 14 is preferably cylindrical having a diameter substantially equal to the diameter of the retention channel 16. The light source 14 is described as cylindrical for purposes of example. Similar to the retention channel 16, the light source 14 can be formed from any shape which corresponds with the shape of the retention channel 16. The light source 14 is preferably chemilluminescent so as to provide a strong source of light that is self-contained and does not require any external power. Having a chemilluminescent light source 14 is described only for purposes of example and any type of light source that is self contained and does not require external power may be used as the light source 14 for the container 10 of the present invention.

As discussed above, the light source 14 is inserted into the retention channel 16 through the recess 22 in the base 19. Prior to insertion therein, the light source must be activated by a user. Upon activation of the light source 14 and receipt by the retention channel 16 of thereof, light is provided through the body 12. The light from the light source 14 is refracted and reflected through any liquid contained within the container 10 and further refracted and reflected through the body 12 in order to provide light to the immediate area surrounding the container 10 of the present invention.

The light source 14 is shown above the base 19 of the container 10. In order to illuminate the illuminable container 10 of the present invention the light source 14 is illuminated and then inserted through the recess 22 in the base 19. Pressure is thereafter provided to the exposed end of the light source 14 in order to insert the light source 14 deeper into the retention channel 16 so that the light source 14 may be locked into place in the docking port 18. The light source 14 is insertable into the retention channel 16 at either end thereof. Thereafter, the user can place the container 10 of the present invention so that the base 19 is parallel to a flat surface thereby illuminating the proximate area.

Figure 7:
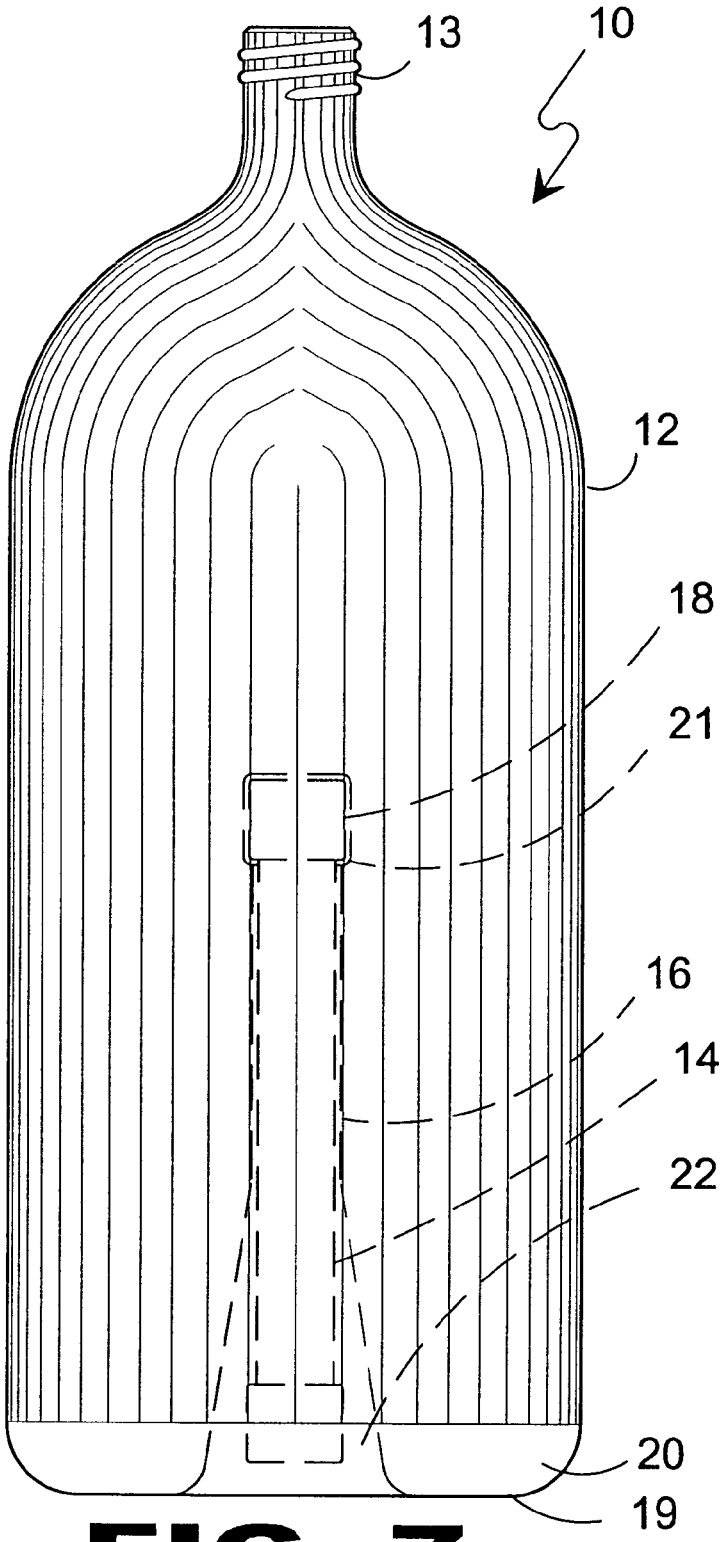
FIG. 7 is a side view of the illuminable container of the present invention having a light source inserted therein.

FIG. 7 is a side view of the illuminable container of the present invention having a light source inserted therein. The container 10 of the present invention has an outer body 12 having a top end 13 with an opening for adding liquid to and pouring liquid out from the body 12 of the container 10. The container also has a base 19 positioned on an end opposite the top end 13. The base 19 is flat so as to provide stability to the container 10 of the present invention. The base 19 has a recess 22 extending therethrough. The recess 22 is positioned at substantially the center of the base 19 and is beveled. The base 19 can be formed in any shape which corresponds to the shape of the body 12 of the container 10. The body 12 is preferably formed from a transparent or translucent material so as to allow light to easily pass therethrough.

A retention channel 16 extends upward from the base 19 and is aligned with the recess 22. Preferably the retention channel 16 is integrally formed with the body 12 of the container 10. The retention channel 16 can extend upward into the body 12 at any desired height so long as the retention channel 16 does not prevent the inflow of liquid into the container 10. The retention channel 16 is able to receive a light source 14 through the recess 22 in the base 19. Preferably the retention channel 16 is cylindrical in shape, however, the retention channel 16 may be formed in any shape. The retention channel 16 has a diameter that is substantially equal to the diameter of the light source 14 thereby ensuring a secure fit after insertion of the light source 14 into the retention channel 16 via the recess 22. The retention channel 16 has a docking port 18 positioned at an end opposite the base 19 of the container 10. The locking port 18 has the lip 21 for locking the light source 14 securely therein.

The light source 14 is preferably cylindrical having a diameter substantially equal to the diameter of the retention channel 16. The light source 14 is described as cylindrical for purposes of example. Similar to the retention channel 16, the light source 14 can be formed from any shape which corresponds with the shape of the retention channel 16. The light source 14 is preferably chemilluminescent so as to provide a strong source of light that is self-contained and does not require any external power. Having a chemilluminescent light source 14 is described only for purposes of example and any type of light source that is self contained and does not require external power may be used as the light source 14 for the container 10 of the present invention.

As discussed above, the light source 14 is inserted into the retention channel 16 through the recess 22 in the base 19. Prior to insertion therein, the light source must be activated by a user. Upon activation of the light source 14 and receipt by the retention channel 16 of thereof, light is provided through the body 12. The light from the light source 14 is refracted and reflected through any liquid contained within the container 10 and further refracted and reflected through the body 12 in order to provide light to the immediate area surrounding the container 10 of the present invention.

FIG. 7 shows the light source 14 being fully retained within the retention channel 16 by the docking port 18. Further shown is the base cover 20 positioned adjacent to the base 19 of the container 10. The base cover 20 provides additional stability to the container by covering the recess 22 in the base 19 and thereby providing the container 10 with a larger surface area on which to rest the container 10. The base cover 20 is described as a solid circular base only for purposes of example and the base cover 20 can be made in any shape which may correspond to the base 19 of the body 12. The base cover 20 also provides increased light reflection through the body 12 of the container because of the reflective coating on the surface of the base cover 20 which is adjacent to the base 19. A mirror is an example of a type of reflective coating that may be positioned on a surface of the base cover which is adjacent to the base 19. A mirror is described for purposes of example and any coating that increases the amount of reflection of light from a light source may be used. Therefore, upon activation of the light source, light will be reflected by the coating on the base cover 20 as well as being reflected and refracted by the contents of the container 10 and the body 12 of the container 10.

Figure 8:
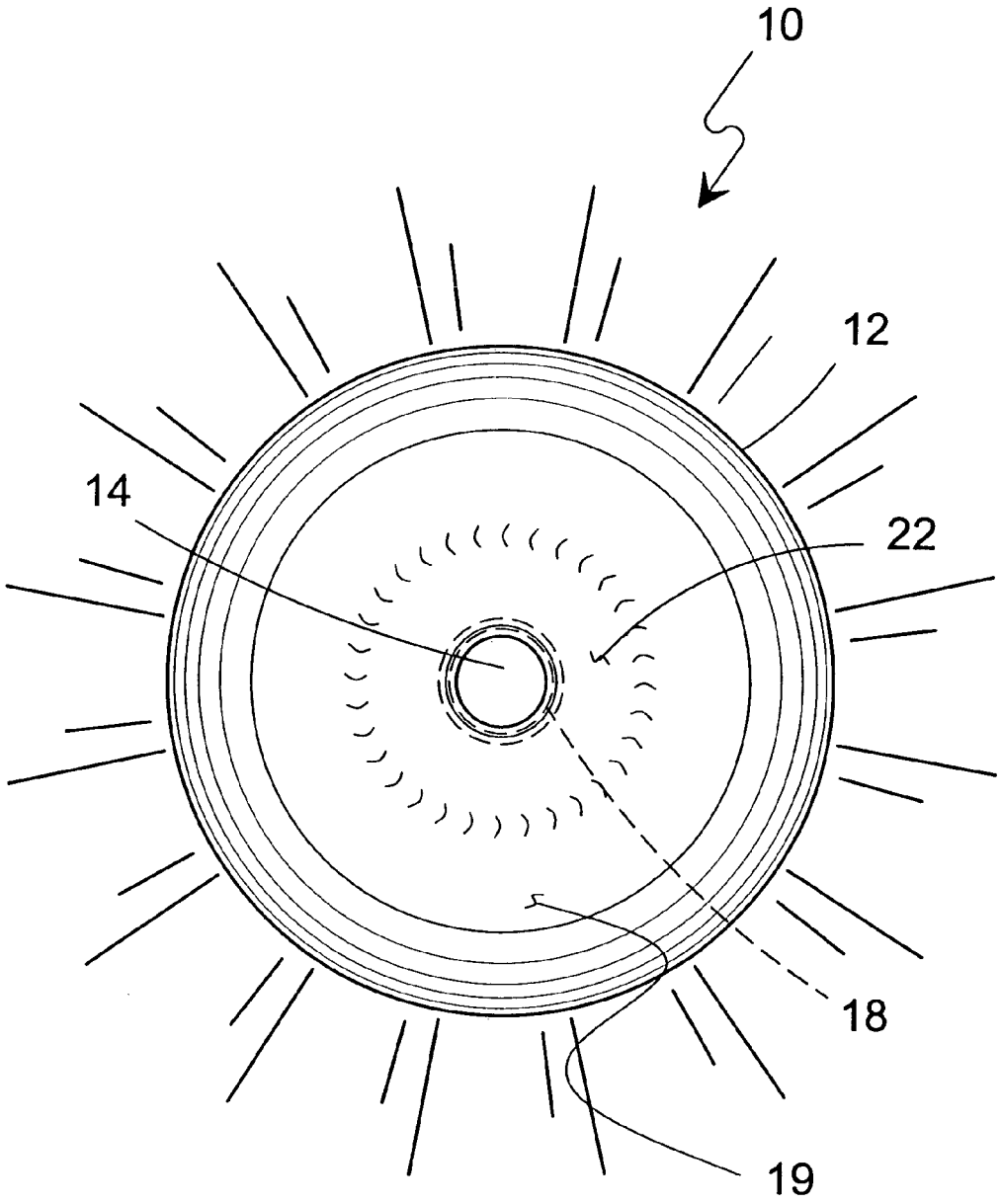
FIG. 8 is a bottom view of the illuminable container of the present invention in an illuminated state having the light source inserted therein.

FIG. 8 is a bottom view of the illuminable container of the present invention in an illuminated state. The container 10 of the present invention has an outer body 12 having a top end 13 with an opening for adding liquid to and pouring liquid out from the body 12 of the container 10. The container also has a base 19 positioned on an end opposite the top end 13. The base 19 is flat so as to provide stability to the container 10 of the present invention. The base 19 has a recess 22 extending therethrough. The recess 22 is positioned at substantially the center of the base 19 and is beveled. The base 19 can be formed in any shape which corresponds to the shape of the body 12 of the container 10. The body 12 is preferably formed from a transparent or translucent material so as to allow light to easily pass therethrough.

A retention channel 16 extends upward from the base 19 and is aligned with the recess 22. Preferably the retention channel 16 is integrally formed with the body 12 of the container 10. The retention channel 16 can extend upward into the body 12 at any desired height so long as the retention channel 16 does not prevent the inflow of liquid into the container 10. The retention channel 16 is able to receive a light source 14 through the recess 22 in the base 19. Preferably the retention channel 16 is cylindrical in shape, however, the retention channel 16 may be formed in any shape. The retention channel 16 has a diameter that is substantially equal to the diameter of the light source 14 thereby ensuring a secure fit after insertion of the light source 14 into the retention channel 16 via the recess 22. The retention channel 16 has a docking port 18 positioned at an end opposite the base 19 of the container 10. The locking port 18 has the lip 21 for locking the light source 14 securely therein.

The light source 14 is preferably cylindrical having a diameter substantially equal to the diameter of the retention channel 16. The light source 14 is described as cylindrical for purposes of example. Similar to the retention channel 16, the light source 14 can be formed from any shape which corresponds with the shape of the retention channel 16. The light source 14 is preferably chemilluminescent so as to provide a strong source of light that is self-contained and does not require any external power. Having a chemilluminescent light source 14 is described only for purposes of example and any type of light source that is self contained and does not require external power may be used as the light source 14 for the container 10 of the present invention.

As discussed above, the light source 14 is inserted into the retention channel 16 through the recess 22 in the base 19. Prior to insertion therein, the light source must be activated by a user. Upon activation of the light source 14 and receipt by the retention channel 16 of thereof, light is provided through the body 12. The light from the light source 14 is refracted and reflected through any liquid contained within the container 10 and further refracted and reflected through the body 12 in order to provide light to the immediate area surrounding the container 10 of the present invention.

The base 19 of the container 10 is shown in FIG. 8. The light source 14 has been activated by the user and has been inserted into the retention channel 16 of the container 10. The light source 14 emits light through the retention channel 16 which is reflected and refracted through the contents of the container 10. The light is then further reflected and refracted through the body 12 of the container 10 thereby providing a light source to illuminate a proximate dark area.

Figure 9:
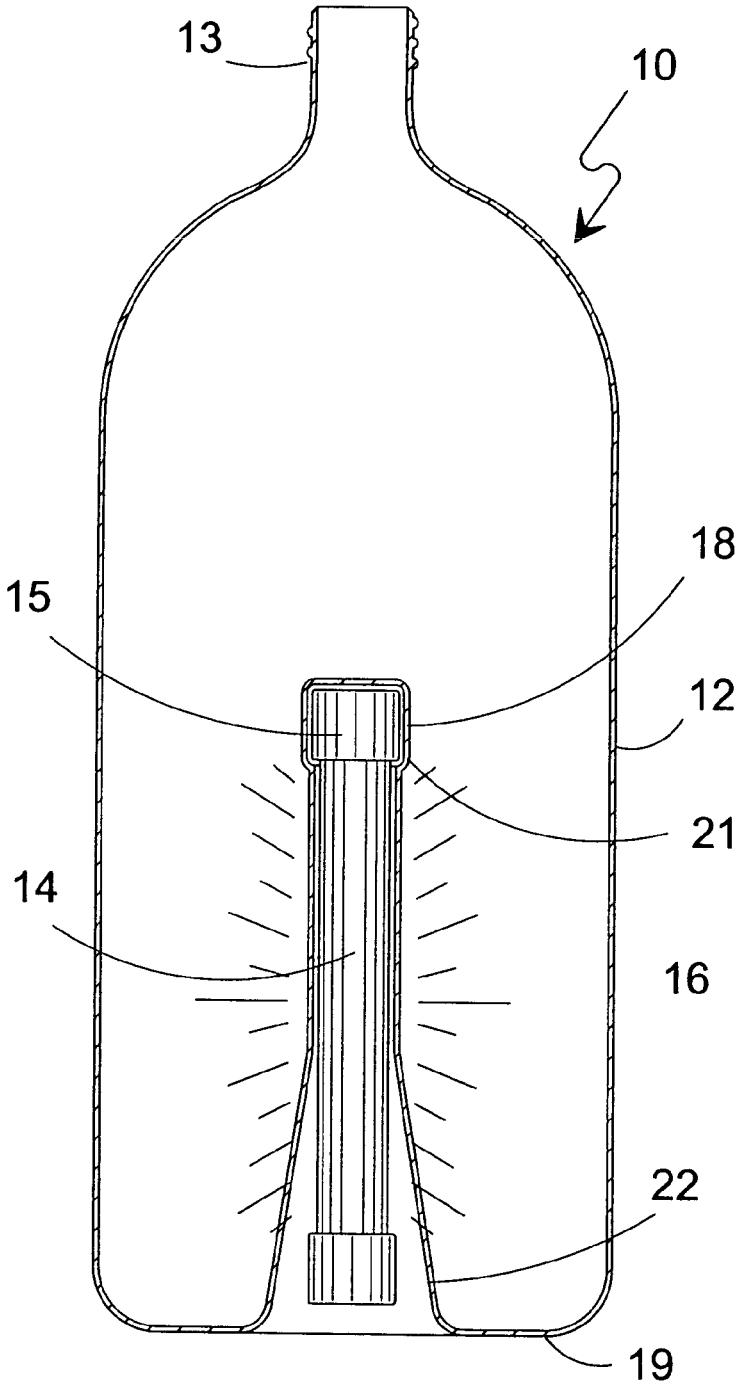
FIG. 9 is a side cross-sectional view of the illuminable container of the present invention in an illuminated state having the light source inserted therein.

FIG. 9 is a cross-sectional view of the illuminable container of the present invention in an illuminated state. The container 10 of the present invention has an outer body 12 having a top end 13 with an opening for adding liquid to and pouring liquid out from the body 12 of the container 10. The container also has a base 19 positioned on an end opposite the top end 13. The base 19 is flat so as to provide stability to the container 10 of the present invention. The base 19 has a recess 22 extending therethrough. The recess 22 is positioned at substantially the center of the base 19 and is beveled. The base 19 can be formed in any shape which corresponds to the shape of the body 12 of the container 10. The body 12 is preferably formed from a transparent or translucent material so as to allow light to easily pass therethrough.

A retention channel 16 extends upward from the base 19 and is aligned with the recess 22. Preferably the retention channel 16 is integrally formed with the body 12 of the container 10. The retention channel 16 can extend upward into the body 12 at any desired height so long as the retention channel 16 does not prevent the inflow of liquid into the container 10. The retention channel 16 is able to receive a light source 14 through the recess 22 in the base 19. Preferably the retention channel 16 is cylindrical in shape, however, the retention channel 16 may be formed in any shape. The retention channel 16 has a diameter that is substantially equal to the diameter of the light source 14 thereby ensuring a secure fit after insertion of the light source 14 into the retention channel 16 via the recess 22. The retention channel 16 has a docking port 18 positioned at an end opposite the base 19 of the container 10. The locking port 18 has the lip 21 for locking the light source 14 securely therein.

The light source 14 is preferably cylindrical having a diameter substantially equal to the diameter of the retention channel 16. The light source 14 is described as cylindrical for purposes of example. Similar to the retention channel 16, the light source 14 can be formed from any shape which corresponds with the shape of the retention channel 16. The light source 14 is preferably chemilluminescent so as to provide a strong source of light that is self-contained and does not require any external power. Having a chemilluminescent light source 14 is described only for purposes of example and any type of light source that is self contained and does not require external power may be used as the light source 14 for the container 10 of the present invention.

As discussed above, the light source 14 is inserted into the retention channel 16 through the recess 22 in the base 19. Prior to insertion therein, the light source must be activated by a user. Upon activation of the light source 14 and receipt by the retention channel 16 of thereof, light is provided through the body 12. The light from the light source 14 is refracted and reflected through any liquid contained within the container 10 and further refracted and reflected through the body 12 in order to provide light to the immediate area surrounding the container 10 of the present invention.

Figure 10:
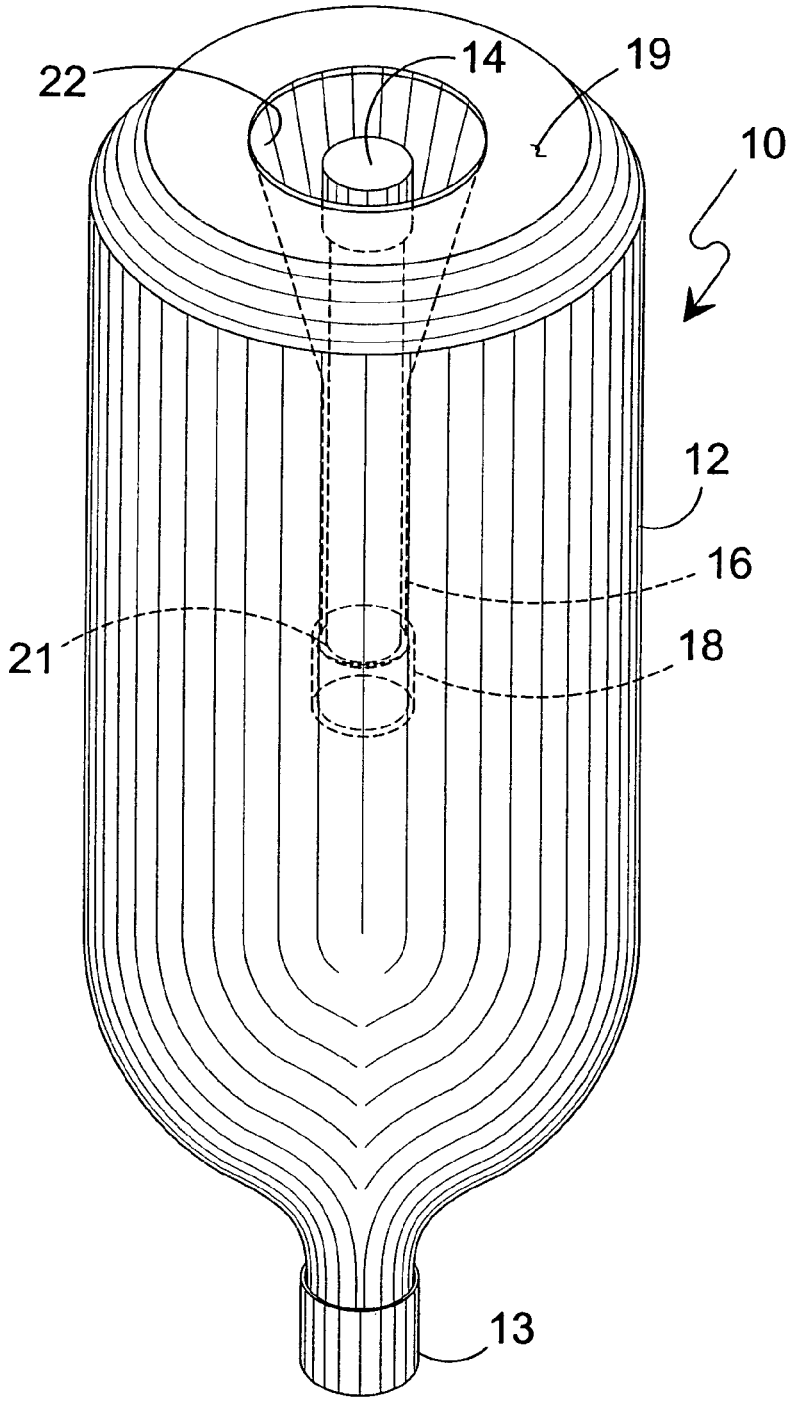
FIG. 10 is a bottom perspective view of the illuminable container of the present invention with light stick therein.

FIG. 10 is a bottom perspective view of the illuminable container of the present invention with light stick therein. The container 10 of the present invention has an outer body 12 having a top end 13 with an opening for adding liquid to and pouring liquid out from the body 12 of the container 10. The container also has a base 19 positioned on an end opposite the top end 13. The base 19 is flat so as to provide stability to the container 10 of the present invention. The base 19 has a recess 22 extending therethrough. The recess 22 is positioned at substantially the center of the base 19 and is beveled. The base 19 can be formed in any shape which corresponds to the shape of the body 12 of the container 10. The body 12 is preferably formed from a transparent or translucent material so as to allow light to easily pass therethrough.

A retention channel 16 extends upward from the base 19 and is aligned with the recess 22. Preferably the retention channel 16 is integrally formed with the body 12 of the container 10. The retention channel 16 can extend upward into the body 12 at any desired height so long as the retention channel 16 does not prevent the inflow of liquid into the container 10. The retention channel 16 is able to receive a light source 14 through the recess 22 in the base 19. Preferably the retention channel 16 is cylindrical in shape, however, the retention channel 16 may be formed in any shape. The retention channel 16 has a diameter that is substantially equal to the diameter of the light source 14 thereby ensuring a secure fit after insertion of the light source 14 into the retention channel 16 via the recess 22. The retention channel 16 has a docking port 18 positioned at an end opposite the base 19 of the container 10. The locking port 18 has a lip for locking the light source 14 securely therein.

The light source 14 is preferably cylindrical having a diameter substantially equal to the diameter of the retention channel 16. The light source 14 is described as cylindrical for purposes of example. Similar to the retention channel 16, the light source 14 can be formed from any shape which corresponds with the shape of the retention channel 16. The light source 14 is preferably chemilluminescent so as to provide a strong source of light that is self-contained and does not require any external power. Having a chemilluminescent light source 14 is described only for purposes of example and any type of light source that is self contained and does not require external power may be used as the light source 14 for the container 10 of the present invention.

As discussed above, the light source 14 is inserted into the retention channel 16 through the recess 22 in the base 19. Prior to insertion therein, the light source must be activated by a user. Upon activation of the light source 14 and receipt by the retention channel 16 of thereof, light is provided through the body 12. The light from the light source 14 is refracted and reflected through any liquid contained within the container 10 and further refracted and reflected through the body 12 in order to provide light to the immediate area surrounding the container 10 of the present invention.

From the above description it can be seen that the illuminable container of the present invention is able to overcome the shortcomings of prior art devices by providing a container having a base with an recess extending therethrough. A channel is aligned with the recess and extends upward into the body of the container. The channel is able to receive a light source, which is preferably chemilluminescent, for illuminating the container and the contents therein.

Furthermore, the illuminable container of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic of specific aspects of this invention.

What is claimed is:

1. An illuminable container for providing illumination comprising:

a) a body having a base, said body being able to retain liquid therein;

b) an recess extending through said base;

c) a retention channel aligned with said recess in said base and extending upward into said body; and d) a light source received within said retention channel for providing illumination, wherein said recess is beveled for aiding in retaining said light source therein; and e) a cap, having a shape corresponding to a shape of said base, wherein said cap is selectively connected to said base via said beveled recess.

2. The illuminable container as recited in claim 1, wherein said retention channel further includes a docking port positioned at an end of said retention channel opposite said recess for retaining said light source within said retention channel.

3. The illuminable container as recited in claim 1, wherein said cap has a reflective coating on a side facing said base of said container for reflecting light from said light source thereby increasing the intensity of the light.

4. The illuminable container as recited in claim 1, wherein said retention channel has a shape which corresponds to a shape of said light source.

5. The illuminable container as recited in claim 1, wherein said retention channel is integrally formed with said body.

6. The illuminable container as recited in claim 5, wherein said retention channel has a diameter substantially equal to a diameter of said light source.

7. The illuminable container as recited in claim 1, wherein said body is formed from at least one of glass and plastic thereby allowing the light from said light source to be refracted and reflected easily therethrough.

8. The illuminable container as recited in claim 1, wherein said body is at least one of transparent and translucent thereby allowing the light from said light source to be refracted and reflected easily therethrough.

9. The illuminable container as recited in claim 1, wherein said light source is a chemilluminescent light source that is selectively activated by a user.

10. An illuminable container for providing light to a dark area comprising:

a) a body having a base, said body being able to retain liquid therein;

b) an recess extending through said base;

c) a retention channel aligned with said recess in said base and extending upward into said body;

d) a docking port positioned at an end of said retention channel opposite said recess; and e) a light source received within said docking port of said retention channel for illuminating said container, wherein said retention channel further includes a docking port positioned at an end of said retention channel opposite said recess for retaining said light source within said retention channel, said recess is beveled for aiding in retaining said light source therein; and f) a cap, having a shape corresponding to a shape of said base, wherein said cap is selectively connected to said base via said beveled recess.

11. The illuminable container as recited in claim 10, wherein said cap has a reflective coating on a side facing said base of said container for reflecting light from said light source thereby increasing the intensity of the light.

12. The illuminable container as recited in claim 10, wherein said retention channel has a shape which corresponds to a shape of said light source.

13. The illuminable container as recited in claim 10, wherein said retention channel is integrally formed with said body.

* * * * *